United States Patent [19]

Okada et al.

[11] Patent Number: 4,783,438

[45] Date of Patent: Nov. 8, 1988

[54] PARTIALLY PRESSURE-SENSITIVE RECORDING PAPER

[75] Inventors: Yoshio Okada, Matsudo; Yuriko Igarashi; Yutaka Igari, both of Iwaki, all of Japan

[73] Assignee: Kureha Kagaku Kogyo Kabushiki Kaisha, Tokyo, Japan

[21] Appl. No.: 17,585

[22] Filed: Feb. 24, 1987

[30] Foreign Application Priority Data

Mar. 3, 1986 [JP] Japan ..... 61-45637

[51] Int. Cl.[4] ..... B41M 5/22

[52] U.S. Cl. ..... 503/206; 427/150; 428/211; 428/914; 503/208; 503/213; 503/215

[58] Field of Search ..... 427/150–152; 503/205, 206, 208, 213, 214, 209, 215; 428/211, 914

[56] References Cited

U.S. PATENT DOCUMENTS 4,640,847 2/1987 Okada et al. ..... 427/151

FOREIGN PATENT DOCUMENTS 59-164186 9/1984 Japan ..... 503/215
60-149489 8/1985 Japan ..... 503/215
60-168690 9/1985 Japan ..... 503/215

*Primary Examiner*—Bruce H. Hess
*Attorney, Agent, or Firm*—Oblon, Fisher, Spivak, McClelland & Maier

[57] ABSTRACT

Disclosed herein is a partially pressure-sensitive recording paper on which an ink has been applied partially, the ink having been prepared by uniformly dispersing microcapsules having a solution of a colorless electron-donating dyestuff as the core material, a thermally melting solid substance and an organic solvent having a mean boiling point of from 250° to 350° C. and a content of aromatic ring carbon of more than 25% while restraining the weight ratio of the solvent to the solid substance and the weight ratio of the solid substance to the microcapsules respectively in a prescribed range.

5 Claims, No Drawings

PARTIALLY PRESSURE-SENSITIVE RECORDING PAPER

BACKGROUND OF THE INVENTION

The present invention relates to a partially pressure-sensitive recording paper produced by applying an ink comprising a uniform dispersion of microcapsules containing a solution of an electron-donating, colorless dyestuff, a thermally melting solid substance and a high-boiling organic solvent partially on a sheet of paper.

While the so-called business form such as slips for business, computor recording paper, etc. have come to be more and more complicated and diversified in recent years with the increase of business efficiency and the automation of business, of such slips and recording paper, there are many cases where they take the form of a copying paper including a plurality of sheets of paper.

In such cases, the pressure-sensitive recording paper is mostly used and generally is prepared by laminating an upper sheet (CB paper), on the lower side of which microcapsules containing a solution of a so-called leuco-type dyestuff as the core substance have been applied, with a lower sheet (CF paper) on the upper side of which acid clay or a resin presenting acidity (color-developer) has been applied. The thus prepared pressure-sensitive recording paper is to develop color by rupturing the microcapsules on the parts where a writing pressure or a typewriting pressure is applied, thereby making the dyestuff contact with the color-developer. On the other hand, in the pressure-sensitive recording paper which can produce a plurality of copied sheets at a time, one or several sheets of paper (CFB paper), on the upper side of which a color-developer has been applied and on the lower side of which microcapsules containing a dyestuff have been applied, are inserted between CB paper and CF paper and is used.

However, in the above case, since the microcapsules have been applied on the whole surface of the CB paper, for instance, in the case wherein specified numbers of the whole sheets are necessary to be copied, or in the case wherein only the specified part of a sheet is necessary to be copied, it is necessary to de-sensitize the color-developer except on the specified sheet or part by using a de-sensitizing ink purposely, to avoid the not-necessary copying. Accordingly, the above-mentioned technique would double the trouble, and it is inevitable that the microcapsules in the de-sensitized part become wasted.

In view of the above-mentioned troubles, it is considered that if it is possible to make only the necessary part retain the microcapsules, the partially pressure-sensitive recording paper can be obtained without using the de-sensitizing ink or without applying the expensive microcapsules on the unnecessary parts. Accordingly, a presentation of the partially pressure-sensitive recording paper prepared by applying the microcapsules only on the necessary part(s) with a method such as spot printing has been required.

In order to answer the requirement, methods for producing the partially pressure-sensitive recording paper by partially applying microcapsules have been developed.

At present, although the pressure-sensitive recording paper is usually produced by applying a slurry comprising microcapsules, a water-soluble binder and an additive on a paper using water as a dispersing medium, in the case where the partially pressure-sensitive recording paper is produced by applying this method with, for instance, spot printing, it is extremely difficult to obtain the product high in practicality, because of the partial creases formed at the time of drying the recording paper.

In order to avoid the above-mentioned defect, for instance, there is a method wherein the microcapsules are dispersed in an organic solvent containing a vehicle and the thus formed dispersion is partially applied on a sheet of paper by a printer of gravure or flexo-system, however, such a printer could not always be easily installed technically, areawise or moneywise. In addition, since such a method uses a large amount of an organic solvent, the method has defects such as polluting the working environment.

Further, there is another method for producing a partially pressure-sensitive recording paper, wherein after partially applying a photo-setting adhesive on a board, microcapsules are adhered to the part before the adhesive solidifies, and thereafter the adhesive is solidified. However, in this method, the adhesive is very expensive at present and there is a defect that the operation in the production thereof is complicated.

Still more, as conventional partially pressure-sensitive recording papers produced by using an ink of thermally melting type, those produced by partial printing using a so-called carbon ink, which is prepared by suspending a colored pigment such as carbon black in an ink of thermally melting type, have been well known. Although the pressure-sensitive recording paper produced by using such a carbon ink has been broadly used due to the simplicity of the printing procedure and the low cost, since the colored pigment has been mixed with a wax and the mixture has been simply applied, such a recording paper has a fatal defect of soiling hands and clothes of persons handling it.

As a method for producing a pressure-sensitive recording paper, wherein the above defects have been improved, a method of using microcapsules retaining a solution of a colorless dyestuff and a thermally melting substance has been proposed in Japanese Patent Publications No. 48-12255 (1973) and 57-53196 (1982).

The Patent Publications disclose a method for producing a pressure-sentitive recording paper by applying an ink comprising a mixture of microcapsules containing a solution of a dyestuff and a thermally melting substance on a surface of a sheet of paper. The largest defect of the pressure-sensitive recording paper obtained by the above method lies in the point that the color-developing property is extremely damaged and when such a pressure-sensitive recording paper is compared to the recording paper of which the whole surface is pressure-sensitive and which is obtained by the most common method for producing the pressure-sensitive recording paper, namely by applying an aqueous dispersion of microcapsules, the method shown in the Japanese Patent Publications cannot be said to be the method which can offer the fully practical pressure-sensitive recording paper in the points of the density of the developed color and the initial speed of color-developing.

Further, in Japanese Patent Application Laid-Open (KOKAI) No. 60-149489 (1985), a method for producing a partially pressure-sensitive recording paper by applying an ink, made by mixing an organic solvent of a relatively low boiling point, a thermally melting substance and microcapsules containing a solution of a colorless dyestuff, on a surface of a paper sheet has been proposed. The density of the developed color and the initial speed of color developing of the thus prepared partially pressure-sensitive recording paper are not inferior to those of the pressure-sensitive recording paper prepared by coating aqueous suspension of microcapsules on whole surface, however, the method has not yet solved the problem of an environmental pollution by the evaporation of the organic solvent of a low boiling point at the time of producing the ink and/or the pressure-sensitive recording paper.

Still more, in Japanese Patent Application Laid-Open (KOKAI) No. 59-164186 (1984), as a preceding technique of the invention, it is disclosed that an oily substance is mixed with a wax as is the case of preparing a conventional carbon ink, and after dispersing the microcapsules containing a dyestuff into the thus formed mixture to prepare an ink, and when the thus prepared ink is applied on a sheet of paper to make an upper sheet and the upper sheet is combined with a lower sheet to develop a color, the density of the developed color on this recording paper is high without any part loss of a letter. However, the Patent Application also states that on the other hand, when the upper sheet is coated by the ink containing the oily substance of a sufficiently large amount for obtaining a high density of developed color and a wax and the upper sheet and the lower sheet are combined, the color is developed by simply rubbing the thus combined sheets lightly with fingers, and accordingly such product has no practical value.

Further, in Comparative Example 2 of the Japanese Patent Application Laid-Open (KOKAI) No. 59-164186, it describes that a pressure-sensitive recording paper using 20 parts by weight of SAS oil N-296 (made by Nippon Petrochemical Co., an oil of diarylalkane series), 60 parts by weight of rice wax and 20 parts by weight of microcapsules was tested and although the color-developing property was favorable, it had many stains.

Still more, this Japanese Patent Applicatioh Laid-Open (KOKAI) No. 59-164186 (1984) discloses a technique for producing a pressure-sensitive recording paper without the stains by microencapsulating all or a part of the oily substance and preparing the ink by dispersing thus prepared microcapsules and the other microcapsules containing a precursor of a dyestuff in a wax.

Moreover, this reference (KOKAI No. 59-164186) defines the oily substance as at least one natural or synthetic oily substance and illustrates cottonseed oil, kerosene, paraffin, naphthenic oil, alkylated biphenyl, alkylated terphenyl, alkylated naphthalene, triarylmethane, chlorinated paraffin, diarylalkane, styreneoligomer which is liquid at ordinary temperature, silicone oil, phthalate ester, phosphate ester, sulfonate ester, diaryl ether, aryl alkyl ether, higher alkylated benzene and caster oil as the examples of the thus defined oily substance. However, the method of this reference (KOKAI No. 59-164186) cannot be said to be a favorable method in the points that the method uses a large amount of the expensive microcapsules, of which process for production is complicated.

Accordingly, there has not been proposed any method for obtaining the truly practical partially pressure-sensitive recording paper by simple method.

As a result of the present inventors' earnest studies for obtaining a partially pressure-sensitive recording paper which is excellent in color-developing property, has no fear of environmental pollution, is free from stains to the extent sufficient in practical use and can be produced by simple process with a low cost, it has been found out that a partially pressure-sensitive recording paper which is as high in quality and as low in cost as the recording paper which has been coated with the aqueous suspension of microcapsules on the whole surface area, can be obtained by using an organic solvent having a boiling point and aromatic ring carbons respectively in a definite range together with microcapsules and a thermally melting solid substance and by prescribing the weight ratio of the organic solvent to the thermally melting solid substance and the weight ratio of the thermally melting solid substance to the microcapsules, and on the basis of these findings, the present invention has been attained.

SUMMARY OF THE INVENTION

The object of the present invention lies in offering a partially pressure-sensitive recording paper which is excellent in color-developing property, has no fear of causing environmental pollution, is free from stains to the extent at least sufficient in practical use and can be produced by a simple method in a low cost. Further, the object of the present invention lies in offering a partially pressure-sensitive recording paper comprising a sheet of paper, on a surface of which microcapsules having a solution of an electron-donating dyestuff as the core material and a thermally melting solid substance have been applied, wherein the thermally melting solid substance contains an organic solvent having a mean boiling point of from 250° to 350° C. and a rate of aromatic ring carbon to the whole carbon of not less than 25%, the weight ratio of the organic solvent to the thermally melting solid substance is from 0.125 to 2.5 and the weight ratio of the thermally melting solid substance to the microcapsules is from 0.5 to 1.5.

DETAILED DESCRIPTION OF THE INVENTION

The high-boiling organic solvent used in the present invention is necessary to make the thermally melting solid substance exist on the surface of the sheet of paper in the state of not hindering the color-developing property and is also necessary for accelerating the color-developing reaction between the solution of the dyestuff and the color-developer after the solution of the dyestuff in the microcapsules has been transferred to the CF paper.

Accordingly, it is necessary that the high-boiling organic solvent, which is used in the present invention and is able to improve the color-developing ability of the recording paper, has a sufficiently high boiling point for being retained in the coated layer without evaporating even after having been coated. For that purpose, it is necessary that the mean boiling point of the solvent is not lower than 250° C. and not higher than 350° C. When the mean boiling point of the solvent is below 250° C., its effect cannot be sufficiently exhibited after preserving the recording paper for a long time. On the other hand, when the mean boiling point of the solvent is over 350° C., such a solvent does not exhibit the effect expected in the present invention although the reason has not been elucidated.

The "mean boiling point of not lower than X° C. or not higher than X° C." herein mentioned means that more than 65% by volume of the solvent is distilled at a temperature of not lower than X° C. or not higher than X° C.

Moreover, it is necessary that the high-boiling organic solvent, which is used in the present invention and exhibits the expected effect, has benzene ring, naphthalene ring, acenaphthene ring, fluorene ring, phenanthrene ring or anthracene ring, which shows the aromaticity of the organic compound, within its molecule, and it is an important matter of the organic solvent that the number of the carbon atoms of the part showing the aromaticity to the whole number of the carbon atoms of the organic solvent is not less than 25%.

Further, even when the organic solvent is a mixture containing many components, such a mixture can be used for the purpose of the present invention, provided that the mixture fulfills the above-mentioned conditions.

As the concrete examples of the high-boiling organic solvent for use in the present invention, alkylbenzene, methylphenyl-phenylmethane, dimethylphenyl-phenylmethane, ethylphenyl-phenylmethane, isopropylphenylphenylmethane, sec-butylphenyl-phenylmethane, tert-butyl-phenyl-phenylmethane, 1-phenyl-1-methylphenylmethane, 1-phenyl-1-dimethylphenylethane, 1-phenyl-1-ethylphenylethane, 1-phenyl-1-isopropylphenylethane, 1,1-dimethylphenylethane, 1-phenyl-2-methylphenylethane, 1-phenyl-2-dimethylphenylethane, 1-phenyl-2-ethylphenylethane, 1-phenyl-2-isopropylphenylethane, 1,2-di(methylphenyl)ethane, 1-phenyl-2-methylphenylpropane, 1-phenyl-2-ethylphenylpropane, 1,2-diphenylbutane, methylnaphthalene, ethylnaphthalene, isopropylnapthalene, sec-butylnaphthalene, tert-butylnaphthalene, methyl-isopropylnaphthalene, diisopropylnaphthalene, amylnaphthalene, methyl-sec-butylnaphthalene, methyl-tertbutylnaphthalene, biphenyl, ethylbiphenyl, isopropylbiphenyl, diethylbiphenyl, triethylbiphenyl, acenaphthene, fluorene, phenanthrene, anthracene, ethylacenaphthene, isopropylacenaphthene, isopropylfluorene, etc. may be used as the representative example. Every one of them can be used singly or as a mixture thereof. Still more, of the above solvents, the solvent which is solid at ordinary temperature exhibits the expected effect on the present invention by using after being mixed with other solvent so that the thus formed mixture is liquid at ordinary temperature.

Furthermore, even other solvent than the above-exemplified can be used as the high-boiling organic solvent provided that the solvent fulfills the condition determined in the present invention.

Still more, even a solvent low in aromaticity can be used as the high-boiling organic solvent provided that a mixture thereof with one of the solvents of high in aromaticity fulfills the condition shown in the present invention.

In the next place, it is desirable that the high-boiling organic solvent of the present invention is mixed with the thermally melting solid substance before dispersing the microcapsules in it. The weight ratio of the high-boiling organic solvent to the thermally melting solid substance must be in a range of from 1 (thermally melting solid substance): 0.125 (high-boiling organic solvent) to 1:2.5. When a ratio of the organic solvent to the solid substance, for instance, is less than 0.125, although the effect of the organic solvent is exhibited just after the application, however, the effect comes to be negligible with the passage of time. The reason of such a phenomenon is considered that the high-boiling organic solvent which has been applied on a sheet of paper together with the thermally melting solid substance shifts into the sheet of paper. On the other hand, when the ratio of the organic solvent to the solid substance is over 2.5, the state of the surface of the thus applied sheet of paper becomes soft and sticky, such a recording paper loses the value as a business form.

The desirable weight ratio of the microcapsules to the thermally melting solid substance in the present invention is from 1 (microcapsule): 0.5 (solid substance) to 1:1.5. When the ratio is over 1.5, the amount of the solid substance exceeds the upper limit of the retaining capacity of the fibers of the paper and the quality of the recording paper is damaged and the function thereof as the recording material is remarkably spoiled and a recording paper having such a ratio cannot be said to be practical. On the other hand, when the ratio is below 0.5, the adhesion of the microcapsules to the paper is poor.

It is necessary that the microcapsules which can be used according to the present invention has properties of being able to be mixed with the organic solvent at a high temperature. One of the properties necessary for that purpose is, at first, that the amount of water adhering around the microcapsules is small. If there are a large amount of water around the microcapsules, a rapid evaporation of water occurs at the time of mixing, and accordingly, rupture of the microcapsules is caused. Therefore, it is necessary to preliminarily dry the microcapsules to reduce the retained water therein before subjecting the microcapsules to the procedure of the present invention. The amount of water around the microcapsules used in the present invention is preferred to be not more than 12% by weight.

Furthermore, the wall membrane of the microcapsules for use in the present invention is solvent-resistant which can safely retain the content of the microcapsules in an organic solvent.

The method for producing the microcapsules is not particularly limited provided that the microcapsules have the above-mentioned properties, however, it is preferable to use the microcapsules produced by one of the methods disclosed in, for instance, Japanese Patent Applications Laid-Open (KOKAI) No. 57-56293 (1982), No. 58-33492 (1983) and No. 58-82785 (1983).

To the thermally melting solid substance which is suitable for use in the present invention, it is most important that the substance is solid at ordinary temperature. Namely, it is preferable that the melting point of the solid substance is not lower than 50° C. Namely, when the melting point of the solid substance is below 50° C. and the substance is mixed with the organic solvent, the thus formed mixture takes a viscous liquid state and accordingly, the mixture can not be coated on a sheet of paper in good state.

As the concrete example of the thermally melting solid substance, carnauba wax, Japan tallow, paraffin wax, crystalline wax, montan wax, polyethylene wax and oxidized wax may be mentioned. The use of wax is not limited to one kind and even when a mixture of not less than two waxes is used, the properties of the present invention is never spoiled.

Still more, in the procedure of the present invention, a surfactant and an inorganic additive may be used together with the microcapsules, the thermally melting solid substance and the high-boiling organic solvent.

The present invention will be explained more in detail as follows while referring to the non-limitative Examples and Comparative Examples.

EXAMPLE 1

This Example 1 shows an example for producing the solvent-resistant, dry microcapsules.

Preparation of Prepolymers

After mixing 630 g of melamine and 1620 g of formaline (an aqueous 37% solution of formaldehyde) which had been adjusted to pH of 9 with an aqueous 2% solution of sodium hydroxide, the mixture was brought into reaction at 70° C.

Just after the dissolution of melamine, 2250 g of water was added to the mixture and the aqueous mixture was stirred for 3 minutes to prepare an aqueous solution of a prepolymer of melamine and formaldehyde.

Separately, 600 g of urea and 1460 g of formalin which had been adjusted to pH of 8.5 with triethanolamine were mixed, and by bringing the mixture into reaction for one hour at 70° C., an aqueous solution of a prepolymer of urea and formaldehyde was obtained.

Preparation of a Cathionic Urea Resin

After mixing 1620 g of formalin and 600 g of urea and adding triethanolamine to the mixture to adjust the pH thereof to 8.8, the mixture was brought into reaction for 30 minutes at 70° C.

To 400 g of the reaction mixture, 24 g of water and 30 g of tetraethylenepentamine were added and the pH of the mixture was adjusted to 3 with 15% hydrochloric acid while stirring the mixture at a temperature of 70° C. The pH of the reaction mixture became lower as the reaction was proceeded, so the pH thereof was readjusted to 3 with an aqueous 15% solution of sodium hydroxide, and the reaction was continued while lowering the reaction temperature to 55° C. At the time when the viscosity of the reaction mixture became 200 cps, the reaction mixture was neutralized with an aqueous 10% solution of sodium hydroxide, and 4000 g of water was added to the reaction mixture to obtain an aqueous solution of a water-soluble cathionic urea resin.

Preparation of the Microcapsules

A mixture of 1000 g of the prepolymer of melamine and formaldehyde, 500 g of the prepolymer of urea and formaldehyde, 1580 g of the aqueous solution of the cathionic urea resin, 620 g of water and 10 g of triethanolamine was adjusted to pH of 5.2 by adding an aqueous 10% solution of citric acid, and 30 g of an aqueous 10% solution of a surfactant (NEOPELEX ®, made by KAO-ATLAS Co.) was added to the mixture to prepare "A" liquid.

Separately, 500 g of crystalviolet lactone was dissolved in 9500 g of diisopropylnaphthalene to prepare "B" liquid.

Into "A" liquid, 1000 ml of "B" liquid was added and the mixture was treated in a homogenizer so that "B" liquid was emulsified into droplets of a mean diameter of from 2 to 8 μm, and the emulsion was adjusted to pH of 3.6 by adding an aqueous 1.0% solution of citric acid while gently stirring the emulsion and keeping the temperature of the emulsion at 30° C. After stirring the emulsion for one hour, 2000 g of water was added. After a lapse of 3 hours, the pH of the emulsion was made to 3.0 by adding an aqueous 20% solution of citric acid, and the stirring was continued for 20 hours to obtain a slurry of microcapsules.

The microcapsules were collected by filtering the slurry through a membrane filter, and after washing the microcapsules with water, the washed microcapsules were dried in a hot-wind drier at 35° C. to obtain 1250 g of the powdery microcapsules of a mean grain diameter of from 4 μm.

EXAMPLE 2

As a thermally melting solid substance, 10 g of carnauba wax (made by NIKKO FINE PRODUCTS Co.) and 20 g of polyethylene wax (made by HOECHST Co.) were added to 30 g of methylnaphthalene which had been heated to 110° C., and the waxes were dissolved in the solvent under stirring. Into the solution, 40 g of the microcapsules obtained in Example 1 were gently added and the mixture was continuously stirred to prepare a dispersion of the microcapsules. By applying the dispersion of the microcapsules on a surface of a sheet of paper at a rate of 5 g/m$^2$ using a printing machine provided with an ANILOX roller having a net-form sustaining layer of 10 cm in width and 5 cm in length, a partially pressure-sensitive recording paper according to the present invention was produced.

EXAMPLE 3

In the same manner as in Example 2 except for using 15 g of methylnaphthalene and 15 g of dodecylbenzene instead of 30 g of methylnaphthalene, another partially pressure-sensitive recording paper was produced.

EXAMPLE 4

In the same manner as in Example 2 except for using 30 g of 1-dimethylphenyl-1-phenylethane instead of 30 g of methylnaphthalene, still another partially pressure-sensitive recording paper was obtained.

EXAMPLE 5

As the thermally melting solid substance, 7 g of carnauba wax (made by NIKKO FINE PRODUCTS Co.) and 18 g of polyethylene wax (made by HOECHST Co.) were added to a mixture of 20 g of methylnaphthalene and 15 g of dodecylbenzene, which had been heated to 110° C., and the thus formed mixture was stirred to dissolve the waxes. Into the solution, 40 g of the dry microcapsules obtained in Example 1 were gently added, and by continuing the stirring, a dispersion of the microcapsules was prepared. By applying the dispersion of the microcapsules on a surface of a sheet of paper at a rate of 5 g/m$^2$ using a printing machine provided with an ANILOX roller having a net-form sustaining layer of 10 cm in width and 5 cm in length, a partially pressure-sensitive recording paper was produced.

EXAMPLE 6

A combination of each of the partially pressure-sensitive recording paper produced in Examples 2 to 5 with a commerciallized CF paper (KANZAKI PAPER MANUFACTURING Co.) and each combination was subjected to color-development by a typewriter made by OLIVETTI Co.

As the strength of the developed color of each of the thus color-developed recording paper, the highest density of the developed color was measured by a chromaticity tester made by McBETH Co. Further, in order to measure the initial speed of color-development of each pressure-sensitive recording paper prepared above, the microcapsules of each recording paper were ruptured by a calender roller (made by YOSHIDA STEEL Co.). At the same time, the measurement of the chromaticity was commenced to obtain the density of the developed color after 30 seconds. The results of the two tests are shown in Table 1.

EXAMPLE 7 (Stain Test)

Each combination of CB and CF papers of recording papers of Examples 2 to 5 prepared in the same manner as Example 6 was subjected to friction test under a load of 500 g (one cycle of going and returning) using a tester for dyeing durability (TOYO SEIKI MANUFACTURING Co.). The color developed was measured by a tester for whiteness (made by TOKYO ELECTRICITY AND COLOR Co.). Results are shown in Table 1. The figure nearer to 100% means less stain.

COMPARATIVE EXAMPLE 1

As the thermally melting solid substance, 20 g of carnauba wax (made by NIKKO FINE PRODUCTS Co.) and 40 g of polyethylene wax (made by HOECHST Co.) were heated to 110° C. under stirring and melted. To the molten liquid of waxes, 40 g of the dry microcapsules obtained in Example 1 were gently added and by continuing the stirring, a dispersion of the microcapsules was prepared. By applying the thus prepared dispersion of the microcapsules on a surface of a sheet of paper at a rate of 5 g/m$^2$ using a printing machine provided with an ANILOX roller having a net-form sustaining layer of 10 cm in width and 5 cm in length, a partially pressure-sensitive recording paper was produced.

COMPARATIVE EXAMPLE 2

As the thermally melting solid substance, 15 g of carnauba wax and 30 g of polyethylene wax (both waxes are same as in Comparative Example 1) were added to a mixture of 2.5 g of methylnaphthalene and 2.5 g of dodecylbenzene, which had been heated to 110° C., and the waxes were dissolved in the mixture under stirring. To the solution, 60 g of the dry microcapsules obtained in Example 1 were gently added and by continuing the stirring, a dispersion of the rate of 4 g/m$^2$ using a printing machine provided with an ANILOX roller having a net-form sustaining layer of 10 cm in width and 5 cm in length, a partially pressure-sensitive recording paper was produced.

COMPARATIVE EXAMPLE 3

As the thermally melting solid substance, 10 g of carnauba wax and 20 g of polyethylene wax (both waxes are same as in Comparative Example 1) were added to 30 g of n-hexadecane which had been heated to 110° C., and the waxes were dissolved in n-hexadecane under stirring. To the solution, 40 g of the dry microcapsules obtained in Example 1 were gently added and by continuing the stirring, a dispersion of the microcapsules was prepared. By applying the dispersion of the microcapsules on a surface of a sheet of paper at a rate of 5 g/m$^2$ using a printing machine provided with an ANILOX roller having a net-form sustaining layer of 10 cm in width and 5 cm in length, a partially pressure-sensitive recording paper was produced.

COMPARATIVE EXAMPLE 4

As the thermally melting solid substance, 10 g of carnauba wax and 20 g of polyethylene wax (both waxes are same as in Comparative Example 1) were added to a mixture of 40 g of methylnaphthalene and 40 g of dodecylbenzene, which had been heated to 110° C. and the waxes were dissolved in the mixture under stirring. To the solution, 50 g of the dry microcapsules obtained in Example 1 were gently added, and by continuing the stirring, a dispersion of the microcapsules was prepared. By applying the dispersion of the microcapsules on a surface of a sheet of paper at a rate of 6 g/m$^2$ using a printing machine provided with an ANILOX roller having a net-form sustaining layer of 10 cm in width and 5 cm in length, a partially pressure-sensitive recording paper was produced.

COMPARATIVE EXAMPLE 5

As the thermally melting solid substance, 10 g of carnauba wax and 20 g of polyethylene wax (both waxes are same as in Comparative Example 1) were added to a mixture of 15 g of methylnaphthalene and 15 g of dodecylbenzene, which had been heated to 110° C. and the waxes were dissolved in the mixture under stirring. To the solution, 80 g of the dry microcapsules obtained in Example 1 were gently added and by continuing the stirring, a dispersion of the microcapsules was prepared. By applying the dispersion of the microcapsules on a surface of a sheet of paper at a rate of 3.5 g/m$^2$ using a printing machine provided with an ANILOX roller having a net-form sustaining layer of 10 cm in width and 5 cm in length, a partially pressure-sensitive recording paper was produced.

COMPARATIVE EXAMPLE 6

A partially pressure-sensitive recording paper was prepared as in Example 2 except that half of 30 g of methylnaphthalene was microencapsulated by the method described in Example 1 and these microcapsules were gently added to the solution of waxes with the microcapsules containing a solution of dyestuff.

After combining CB paper produced in Comparative Examples 1 to 6 with CF paper as is described in Example 6, the density of developed color, the initial color-developing property and the stains were measured as described in Examples 6 and 7. The results are also shown in Table 1.

On comparing the test results of Examples and Comparative Examples shown in Table 1, it was found that the color-developing performance of every one of the recording paper produced in Examples was superior to that of produced in Comparative Examples, particularly in the point of the initial color-developing property.

As to the test for the stains, Comparative Examples Nos. 2, 5 and 6, especially 6, are not good. These are due to the roughness of a surface of a sheet of paper coated with microcapsules. The cause of this roughness is thought to be small values of the weight ratio of wax/MC and/or solvent/wax. In Comparative Example 6, microencapsulated solvent should not be considered as solvent as far as it concerns to coating.

TABLE 1

| No. | Weight Ratio of Materials | | | | | Density of Developed Color | | Other Properties | | |
|---|---|---|---|---|---|---|---|---|---|---|
| | Wax | Solvent | MC | Solvent/Wax | Wax/MC | (A)[1] | (B)[2] | Appearance | Adhesion of MC | Stain (%) |
| Example | | | | | | | | | | |
| 2 | 30 | 30 | 40 | 1.0 | 0.75 | 0.79 | 0.88 | good | good | 98 |
| 3 | 30 | 30 | 40 | 1.0 | 0.75 | 0.73 | 0.84 | good | good | 99 |
| 4 | 30 | 30 | 40 | 1.0 | 0.75 | 0.76 | 0.86 | good | good | 98 |
| 5 | 30 | 35 | 40 | 1.4 | 0.625 | 0.77 | 0.86 | good | good | 99 |
| Comparative Example | | | | | | | | | | |
| 1 | 60 | 0 | 40 | 0 | 1.5 | 0.42 | 0.70 | good | good | 94 |
| 2 | 45 | 5 | 60 | 0.11 | 0.75 | 0.46 | 0.72 | good | good | 90 |
| 3 | 30 | 30 | 40 | 1.0 | 0.75 | 0.65 | 0.70 | good | good | 98 |
| 4 | 30 | 80 | 50 | 2.66 | 0.6 | 0.58 | 0.70 | (3) | — | 97 |
| 5 | 30 | 30 | 80 | 1.0 | 0.375 | 0.70 | 0.80 | — | (4) | 90 |
| 6 | 30 | 15 + 15 | 40 | 1.0 | 0.75 | — | 0.89 | (5) | good | 88 |

[1]After 30 seconds of typewriting; [2]The maximum density; [3]Slightly sticky; [4]Partially fallen off; [5]Coated surface with MC is rough
In the Table, Wax means thermally melting solid substance, MC means microcapsule.

After preserving the recording papers obtained in Example 3 and Comparative Example 5 for 6 months, the color-developing property of each recording paper was measured by the method described in Example 6. The results, as shown in Table 2, showed that although the color-developing property of the recording paper of Comparative Example 5 was spoiled, that of Example 3 was completely unchanged and was retained in the initial level.

Furthermore, on preserving the recording paper of Comparative Example 5, the falling off of the microcapsules from the recording paper was clearly observed.

TABLE 2

| No. | Density of Developed Color | |
|---|---|---|
| | After 30 seconds | Maximum Value |
| Example 3 | 0.73 | 0.84 |
| Comparative Example 5 | 0.45 | 0.75 |

What is claimed is:

1. A partially pressure-sensitive recording paper, comprising:

a sheet of paper on a surface of which is partially applied a mixture of a thermally melting solid substance and an organic solvent having a mean boiling point of from 250° to 350° C. whose composition is such that the number of aromatic ring carbon atoms relative to the number of all carbon atoms in the molecules of said solvent is not less than 25%, said mixture having dispersed therein microcapsules containing a solution of an electron-donating dyestuff as the core material, the weight ratio of the organic solvent to the thermal melting solid substance ranging from 0.125 to 2.5 and the weight ratio of the thermally melting solid substance to the dispersed microcapsules ranging from 0.5 to 1.5.

2. The partially pressure-sensitive recording paper of claim 1, wherein the melting point of said thermally melting solid substance is not less than 50° C.

3. The partially pressure-sensitive recording paper of claim 1, wherein said thermally melting solid substance is at least one substance selected from the group consisting of carnauba wax, Japan tallow, paraffin wax, crystalline wax, montan wax, polyethylene wax and oxidized wax.

4. The partially pressure-sensitive recording paper of claim 1, wherein the wall membrane of said microcapsules has a resistivity to said organic solvent and the amount of water which adheres to the microcapsules amounts to not more than 12% by weight.

5. The partially pressure-sensitive recording paper of claim 1, wherein said high-boiling organic solvent is a member selected from the group consisting of alkylbenzene, methylphenyl-phenylmethane, dimethylphenyl-phenyl-methane, ethylphenyl-phenyl-methane, isopropylphenyl-phenylmethane, sec-butyl-phenyl-phenylmethane, tert-butyl-phenyl-phenylmethane, 1-phenyl-1-methylphenylmethane, 1-phenyl-1-dimethylphenylethane, 1-phenyl-1-ethylphenylethane, 1-phenyl-1-isopropylphenylethane, 1,1-dimethylphenylethane, 1-phenyl-2-methylphenylethane, 1-phenyl-2-dimethylphenylethane, 1-phenyl-2-ethylphenylethane, 1-phenyl-2-isopropyl-phenylethane, 1,2-di(methylphenyl)ethane, 1-phenyl-2-methyl-phenylpropane, 1-phenyl-2-ethylphenylpropane, 1,2-diphenyl-butane, methylnaphthalene, ethylnaphthalene, isopropyl-naphthalene, sec-butylnaphthalene, tert-butylnaphthalene, methyl-isopropylnaphthalene, diisopropylnaphthalene, amylnaphthalene, methyl-sec-butylnaphthalene, methyl-tert-butylnaphthalene, biphenyl, ethylbiphenyl, isopropylbiphenyl, diethylbiphenyl, triethylbiphenyl, acenaphthene, fluorene, phenanthrenen, anthracene, ethylacenapthene, isopropyl-acenaphthene and isopropylfluorene.

* * * * *